US006073528A

United States Patent [19]

Porter

[11] Patent Number: 6,073,528

[45] Date of Patent: Jun. 13, 2000

[54] CHAIN SAW JIG

[76] Inventor: Gerald R. Porter, 47 Susan Dr., Westfield, Mass. 01085

[21] Appl. No.: 09/226,015

[22] Filed: Jan. 6, 1999

[51] Int. Cl.[7] ..... B27B 17/00

[52] U.S. Cl. ..... 83/454; 30/371; 30/381; 83/468.4; 83/468.7; 83/574; 83/796

[58] Field of Search ..... 30/370, 382, 378, 30/371–387; 83/745, 454, 456, 465, 468.2, 708.4, 468.5, 468.6, 468.7, 796, 797, 574, 834, 467.1, 798, 743; 269/102, 296

[56] References Cited

U.S. PATENT DOCUMENTS

| | | | |
|---|---|---|---|
| 642,502 | 1/1900 | Spencer et al. | 83/743 |
| 1,063,986 | 6/1913 | Lowe et al. | 83/743 |
| 1,154,624 | 9/1915 | Gooch | 83/743 |
| 1,266,355 | 5/1918 | Urbanski | 83/743 |
| 1,371,122 | 3/1921 | Smith | 83/743 |
| 1,488,073 | 3/1924 | Smith | 83/743 |
| 2,541,508 | 2/1951 | Fleming | 269/89 X |
| 2,851,067 | 9/1958 | Greenslate | 83/796 |
| 3,053,290 | 9/1962 | Fitzgerald | 269/296 |
| 3,636,996 | 1/1972 | Lanz . | |
| 4,214,498 | 7/1980 | Zukas et al. | 83/796 |
| 4,257,162 | 3/1981 | Pardon | 30/161 |
| 4,283,980 | 8/1981 | Jackson | 83/574 X |
| 4,294,012 | 10/1981 | Lanz | 30/378 |
| 4,307,640 | 12/1981 | Michael | 83/574 |
| 4,342,243 | 8/1982 | Porritt | 83/574 |
| 4,350,067 | 9/1982 | Picard | 83/796 |
| 4,538,494 | 9/1985 | Wirfelt | 83/796 |
| 4,606,252 | 8/1986 | Lahti | 83/796 X |
| 4,611,521 | 9/1986 | McCardle | 83/574 |
| 4,757,735 | 7/1988 | Olson | 83/797 |
| 4,888,872 | 12/1989 | Eistrat | 30/371 |
| 4,945,641 | 8/1990 | Miller et al. | 30/382 |
| 4,949,613 | 8/1990 | Bone | 83/574 |
| 5,123,168 | 6/1992 | Lyons . | |
| 5,511,315 | 4/1996 | Raya | 30/371 |
| 5,568,758 | 10/1996 | Moore | 83/574 X |

*Primary Examiner*—Kenneth E. Peterson
*Attorney, Agent, or Firm*—Ross, Ross & Flavin

[57] ABSTRACT

The bar of a chain saw is attached to a jig which includes a support block pivotally attached to a pair of spaced support arms extending outwardly therefrom for supporting a log or branch to be cut, and fingers extending angularly forwardly and upwardly from the ends of the support arms for scooping up logs and branches from the ground onto the support arms and into contact with a pair of spaced upright, toothed stop arms on the support arms which prevent kickback or twisting of the log or branch as it is being cut by the chain saw as the support block is pivoted relative to the support arms between non-use and use positions.

5 Claims, 3 Drawing Sheets

CHAIN SAW JIG

BACKGROUND OF THE INVENTION

1. Field of the Invention

The invention relates to an attachment for a chain saw to provide greater safety by stabilizing small logs and branches to be cut, thereby preventing saw kickback or binding.

2. Description of the Related Art

Various saw stands or supports, chain saw guards and chain saw attachments for aiding in cutting branches or logs are known.

However, all have serious drawbacks in that they are expensive or complicated in their structure, or unreliable in their use.

BRIEF SUMMARY OF THE INVENTION

It is an object of the invention to provide an inexpensive, uncomplicated, reliable attachment for a chain saw for preventing kickback and assuring operator safety.

Herein, the bar of a chain saw is attached to a jig which includes a support block pivotally attached to a pair of spaced support arms extending outwardly therefrom for supporting a log or branch to be cut, and fingers extending angularly forwardly and upwardly from the ends of the support arms for scooping up logs and branches from the ground onto the support arms and into contact with a pair of spaced upright, toothed stop arms on the support arms which prevent kickback or twisting of the log or branch as it is being cut by the chain saw as the support block is pivoted relative to the support arms to move the chain saw between non-use and use positions.

The toothed stop arms may be positioned at either of two positions relative to the support arms.

In a first position, the stop arms may be located distantly from the support block so that small branches or the like on the ground may be scooped up by the fingers on the support arms and positioned against the stop arms to be cut by the chain saw as the support block is pivoted relative to the support arms to move the chain saw between non-use and use positions without the danger of the wood being sucked rearwardly and possibly causing injury to the operator.

Alternatively, the stop arms may be located in a second position closer to the support block for cutting larger branches or logs while still supporting the wood and preventing kickback or binding as the chain saw is pivoted between non-use and use positions.

The double support arms and stop arms are spaced at equal distances from the center of the chain and bar on both sides. With the two support arms located at this equal distance, the log can be cut with little effort without twisting and binding of the chain which would occur with a single support arm. Stop surfaces on the support block, upon contact with the support arms, limit the range of pivotal movement of the support block as the chain saw is moved between non-use and use positions, thereby allowing the wood to be cut through without the chain running into the ground after cutting.

A safety mounting bracket is optionally provided in one embodiment whereby the jig can be attached to a supporting surface such as a stand, stump or log.

DETAILED DESCRIPTION OF THE INVENTION

Figure 1:
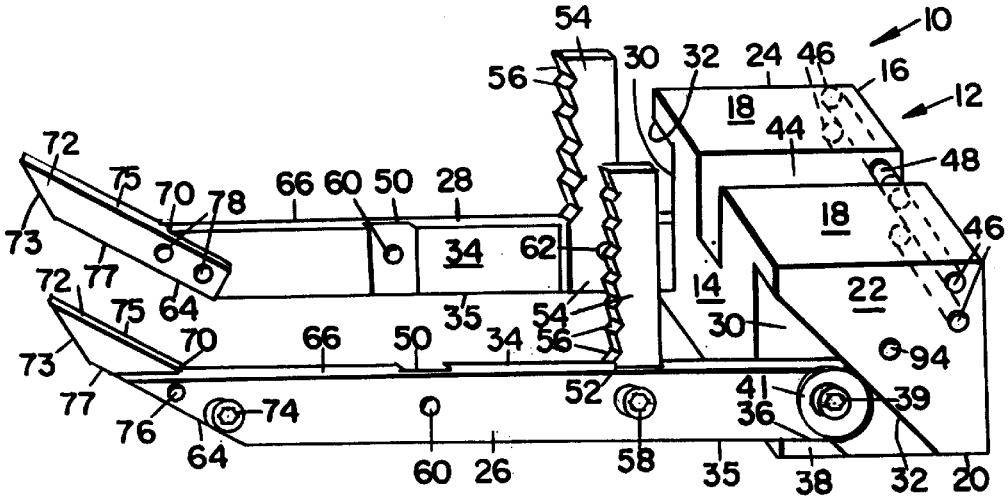
FIG. 1 is a front perspective view of a chain saw jig embodying a preferred form of the invention disposed in a non-use position for cutting large logs or branches.

A chain saw jig embodying a preferred form of the invention is generally indicated by 10 and includes a substantially square or rectangular solid, chain saw support block generally indicated by 12, having spaced, parallel, vertically disposed forward and rearward surfaces 14 and 16 respectively, interconnected by spaced, parallel, horizontally disposed upper and lower surfaces 18 and 20 respectively, which are interconnected by spaced, parallel, vertically disposed side surfaces 22 and 24.

A pair of spaced, generally flat, vertically disposed, elongated support arms 26 and 28 extends generally horizontally forwardly from chain saw support block 12.

Each side face 22 and 24 of chain support block 12 is cut away or relieved as at 30 to provide an angularly disposed slot 32 which extends downwardly and rearwardly at an approximately 45° angle between forward surface 14 and lower surface 20 of the support block.

A rearward end of each support arm 26 and 28 is received in a slot 32 of side surfaces 22 and 24 of the support block, with a flat, upright inner face 34 of each support arm resting flush against the base wall of each cut away 30, and with a lower face 35 of each support arm resting on a horizontally extending upper face 36 of an abutment 38 which is located at the lower end of each slot 32 and extends to forward surface 14 of the support block.

Figure 5:
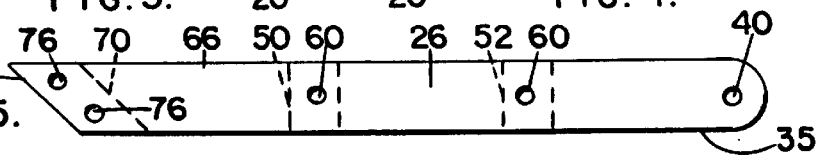
FIG. 5 is a front elevational view of one of the support arms of the chain saw jig of FIG. 1 with the stop arm and finger omitted for clarity.
Figure 6:
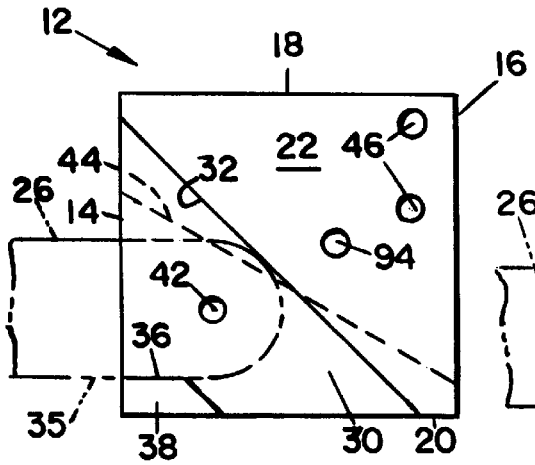
FIG. 6 is a front elevational view on a larger scale of the chain saw support block of FIG. 1 in a non-use position with the support arm shown fragmentarily and in phantom.
Figure 7:
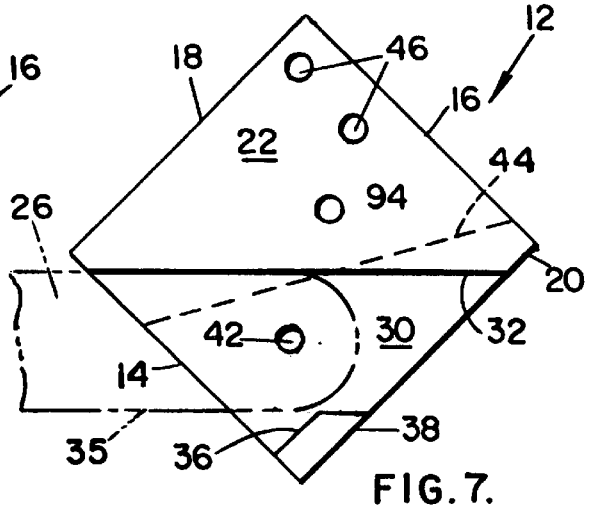
FIG. 7 is a front elevational view similar to FIG. 6 of the chain saw support block of FIG. 1 in a use position with the support arm shown fragmentarily and in phantom.

The rearward end of each support arm 26 and 28 is pivoted to respective side faces 22 and 24 of support block 12 as by a pivot bolt 39 which extends freely through a washer 41 and a provided through opening 40 in each support arm, best seen in FIG. 5, and is threadedly engaged in a provided tapped opening 42, best seen in FIGS. 6 and 7, which extends horizontally inwardly from the base wall of each cut away 30 of each side wall 22 and 24 of the support block.

Chain saw support block 12 is provided with a central, vertically disposed slot 44 which extends downwardly from its upper surface 18.

Slot 44 extends angularly downwardly and rearwardly at an approximately 30° angle between front surface 14 of the chain saw support block and rearward surface 16 thereof.

Slot 44 is of sufficient width to accommodate a bar B and chain C of a chain saw S, as will appear.

Pairs of vertically spaced, aligned, tapped openings 46 extend horizontally inwardly from each side surface 22 and 24 of chain saw support block 12 and open into slot 44.

Figure 2:
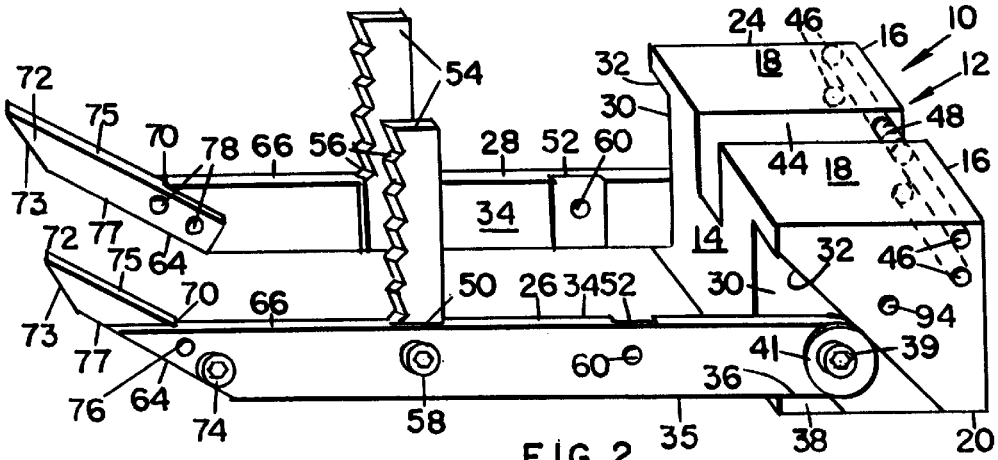
FIG. 2 is a front perspective view similar to FIG. 1 with the chain saw jig disposed in a non-use position for cutting small logs or branches.
Figure 3:
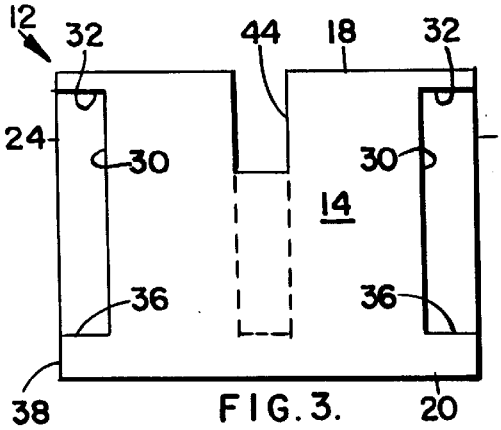
FIG. 3 is an end elevational view on a larger scale of the chain saw support block of the chain saw jig as seen from the left of FIG. 1 with the support arms omitted for clarity.
Figure 4:
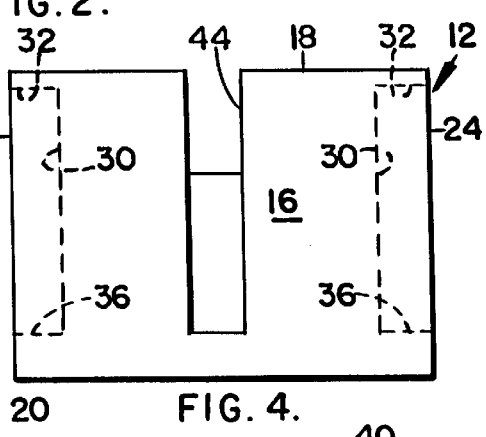
FIG. 4 is a rear elevational view similar to FIG. 3 of the chain saw support block as seen from the right of FIG. 1.

As best seen in FIGS. 1 and 2, tapped openings 46 accommodate socket screws 48 for securing bar B of chain saw S within slot 44, the socket screws being threadedly engaged in provided tapped openings, not shown, in chain saw bar B.

Each support arm 26 and 28 is provided on its inner face 34 with a pair of spaced inwardly extending vertically disposed, forward and rearward slots 50 and 52 respectively, with rearward slots 52 being parallel to each other and being positioned immediately forwardly of forward surface 14 of chain saw support block 12, and with forward slots 50 being parallel to each other and being positioned approximately centrally of each support arm 26 and 28.

Slots 50 and 52 of each support arm 26 and 28 are of appropriate size to accommodate the lower ends of a pair of flat, generally rectangular, toothed, vertically extending stop arms 54, which can be selectively positioned in rearward slots 52 or forward slots 50, for purposes to appear.

The forward edge of each toothed stop arm 54 is provided with a series of work engaging teeth 56 and each stop arm is secured within slots 52 or 50 as by bolts 58 which extend through openings 60 in support arms 26 and 28, and are threadedly engaged in openings 62 in stop arms 54.

The forward free ends of support arms 26 and 28 are angularized so as to provide a forwardly facing face 64 which extends angularly downwardly and rearwardly at an approximately 30° angle from a top surface 66 to lower surface 35 of each support arm.

The forward end of each support arm is provided on its inner face 34 with an angular slot 70 which is coincident with forwardly facing face 64 and is of appropriate size to accommodate the rearward ends of a pair of substantially flat, rectangular fingers 72 which extend angularly upwardly and forwardly from the support arms and are secured in slots 70 as by bolts 74 which extend through openings 76 in support arms 26 and 28 and are threadedly engaged in openings 78 in fingers 72.

The forward free ends of each finger 72 are angularized so as to provide a forwardly facing face 73 which extends angularly downwardly and rearwardly at an approximately 30° angle from a top surface 75 to a lower surface 77 of each finger with lower surfaces 77 being aligned with the forward faces 64 of support arms 26 and 28.

This configuration of the forward ends of fingers 72 and their angular disposition on the ends of support arms 26 and 28 facilitates their use to scoop up branches or logs from the ground and onto the support arms.

Figure 8:
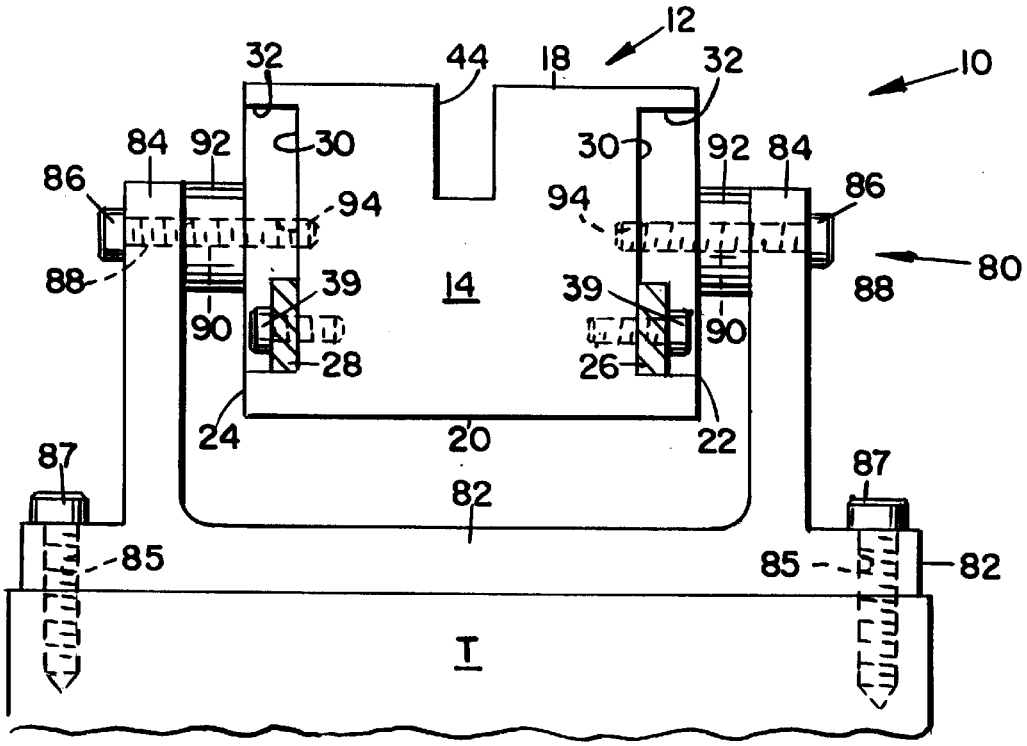
FIG. 8 is an end elevational, part sectional view of a modified form of chain saw jig which includes a safety mounting bracket.

As shown in FIG. 8, chain saw jig 10 may optionally be secured in a safety mounting bracket, generally indicated by 80 which may, in turn, be secured to any suitable supporting surface T, such as a support table, tree stump, or large log.

Safety mounting bracket 80 is generally U-shaped in end elevation and includes a horizontally disposed, flat substantially rectangular base 82 having a pair of flat, generally rectangular, spaced, upright, parallel trunnions 84 located inwardly of each end thereof.

A central, inwardly extending slot 85 is provided at each end of base 82 for facilitating attachment of mounting bracket 80 to supporting surface T as by lag screws 87 or the like.

The spacing between trunnions 84 is appropriate to freely receive chain saw support block 12 therebetween, with the support block being pivotally mounted for swinging movement between the trunnions as by pivot bolts 86 which extend freely through aligned openings 88 and 90 in the trunnions and nylon bushings 92 respectively provided on the inner faces of the trunnions and which are threadedly engaged at their inner ends in tapped openings 94 provided in side surfaces 22 and 24 of support block 12.

Chain saw jig 10 can be used in any one of several configurations, with bar B of chain saw S being disposed in slot 44 of the support block and being fixed to the support block by socket screws 48 in all configurations.

Figure 9:
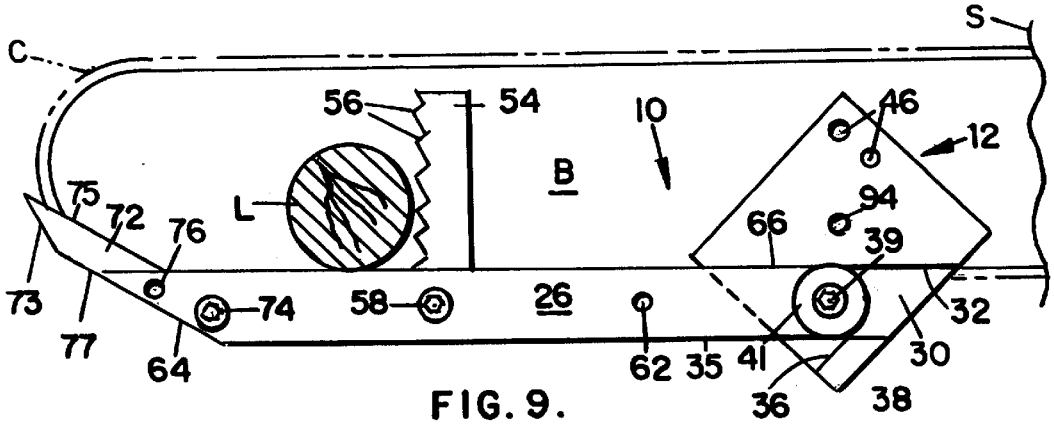
FIG. 9 is a front elevational view of the chain saw jig of FIG. 1 in use in a first configuration with a chain saw following cutting of a small log or branch by the chain saw.

In a first configuration, as shown in FIGS. 2 and 9, toothed stop arms 54 are disposed in forward slots 50 of support arms 26 and 28 and support block 12 is not attached to safety mounting bracket 80.

In this configuration, fingers 72 of support arms 26 and 28 are used to scoop up branches or small logs L from the ground and into a supported position on support arms 26 and 28 resting against teeth 56 of toothed stop arms 54, whereupon support block 12 is rotated in a counterclockwise direction for moving the chain saw between non-use and use positions relative to support arms 26 and 28 to swing bar B and chain C in a downward arc to cause chain C to cut through the branch or small log L, with the stop arms 54 and teeth 56 preventing any rotation, kickback, rearward movement or twisting of log L or binding of the chain in the log.

Contact of the upper edges of slots 32 in side surfaces 22 and 24 of support block 12 with the top surfaces 66 of support arms 26 and 28 limits the range of pivotal movement of the support block and chain saw S between non-use and use positions and precludes contact of chain C with the ground.

In a non-use position, prior to a cutting operation, the lower face of bar B of chain saw S is angled upwardly, at an approximately 30° angle. In this position, the lower surface 20 of support block 12 is horizontally disposed and the lower faces 35 of the support arms rest on the upper face 36 of support block abutment 38, as shown in FIGS. 1, 2 and 6.

In a use position, following a cutting operation, the lower face of bar B of chain saw S is angled downwardly, slightly past a 180° angle, with the upper walls of slots 32 in support block 12 contacting the top surfaces 66 of work support arms 26 and 28, as shown in FIGS. 7 and 9–11.

Figure 10:
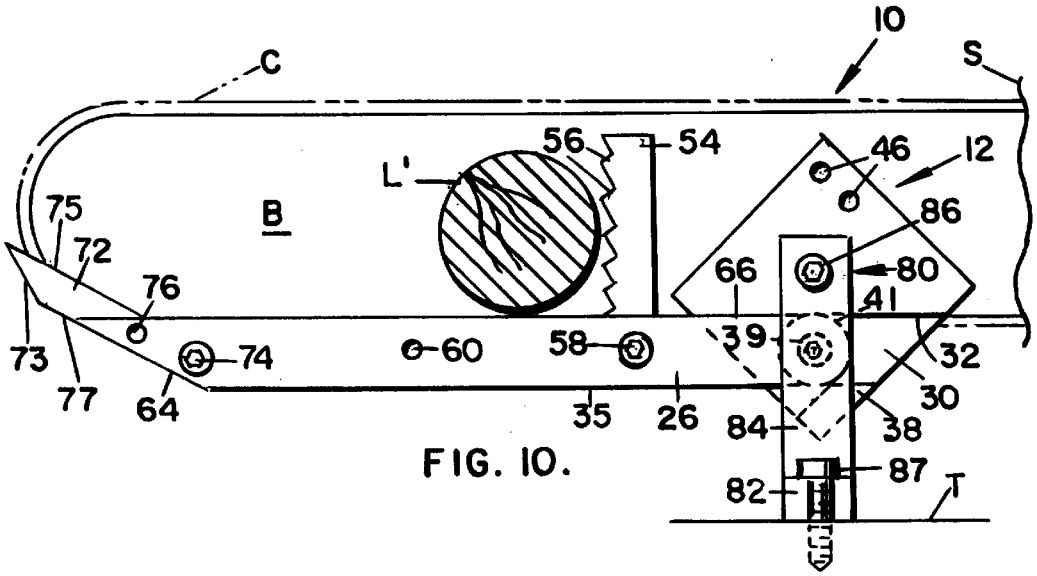
FIG. 10 is a front elevational view of the chain saw jig of FIG. 8 in a second configuration in use with a chain saw and following cutting of a large log or branch by the chain saw.

In a second configuration, as shown in FIGS. 1 and 10, toothed stop arms 54 are disposed in rearward slots 52 of support arms 26 and 28, and support block 12 is attached to safety mounting bracket 80, which is fixed to supporting surface T.

In this configuration, a larger log L' is supported on support arms 26 and 28 and rests against teeth 56 of stop arms 54.

Support block 12 is rotated in a counterclockwise direction between non-use and use positions relative to safety mounting bracket 80 and support arms 26 and 28 as previously described to move bar B and chain C downwardly to cause chain C to cut through log L', with stop arms 54 and teeth 56 preventing any rotation, kickback, or rearward movement of the log or binding of the chain in the log.

As with the first configuration, contact of the upper edges of slots 32 in side surfaces 22 and 24 of support block 12 with the top surfaces 66 of support arms 26 and 28 limits the range of pivotal movement of the support block between non-use and use positions.

Figure 11:
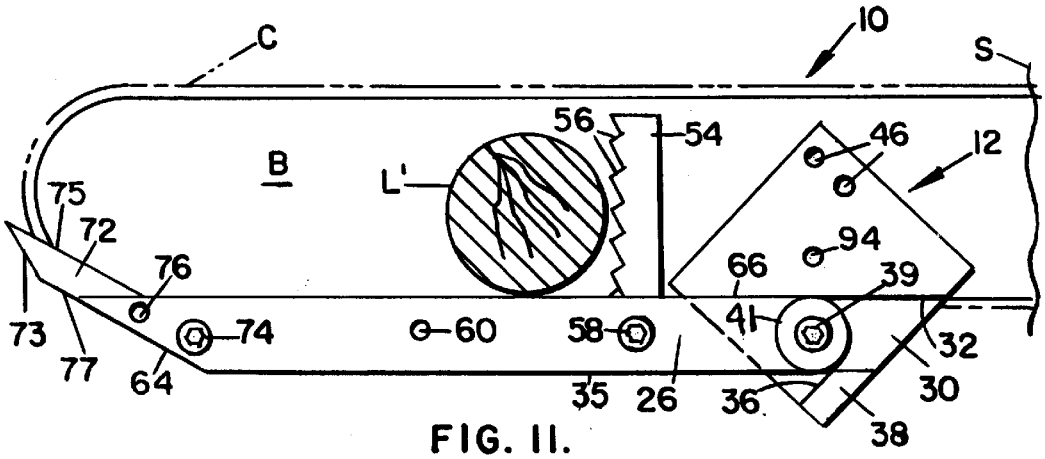
FIG. 11 is a front elevational view of the chain saw jig of FIG. 1 in a third configuration in use with a chain saw and following cutting of a large log or branch by the chain saw.

In a third configuration, as shown in FIG. 11, toothed stop arms 54 are disposed in rearward slots 52 of support arms 26 and 28. However, support block 12 is not attached to safety mounting bracket 80, allowing for free movement of chain saw jig 10 and chain saw S from place to place.

In this configuration of FIG. 10, as with the second configuration, a larger log L' is supported on support arms 26 and 28 and rests against teeth 56 of stop arms 54.

Support block 12 is rotated in a counterclockwise direction between non-use and use positions relative to support arms 26 and 28 to move bar B and chain C downwardly to cause chain C to cut through log L', with stop arms 54 and teeth 56 preventing any rotation, kickback, or rearward movement of the log or binding of the chain in the log.

As with the second configuration, contact of the upper edges of slots 32 in side surfaces 22 and 24 of support block 12 with the top surfaces 66 of support arms 26 and 28 limits the range of pivotal movement of the support block between non-use and use positions.

I claim:

1. A jig for a chain saw having a bar and chain, the jig comprising:

a support block having a central slot for fixedly receiving therein the chain saw bar, said central slot extending obliquely to the peripheral surfaces of said support block, a pair of spaced, parallel support arms pivotally attached to the support block and extending forwardly and outwardly therefrom for supporting thereon a log or branch to be cut, a first one of said support arms being on one side of said central slot, and a second one of said support arms being on the other side of said central slot, the support block being swingable relative to the support arms for moving the chain saw bar and chain thru a cutting stroke, and stop surfaces on the support block engageable with the support arms for limiting the range of pivotal movement of the support block as the chain saw bar is pivoted thru said cutting stroke, the stop surfaces on the support block being side slots adjacent each support arm, said side slots extending obliquely to the peripheral surfaces of said support block such that said chain saw bar cannot pivot past the support arms during said cutting stroke, and fingers extending angularly forwardly and upwardly from the ends of the support arms for scooping up logs and branches from the ground onto the support arms.

2. A jig for a chain saw according to claim 1, including a pair of spaced upright, toothed stop arms on the support arms for preventing kickback or twisting of a log or branch as it is being cut by the chain saw.

3. A jig for a chain saw according to claim 2, wherein the toothed stop arms are positioned adjacent the rear ends of the support arms to provide stops for large logs or branches.

4. A jig for a chain saw according to claim 2, wherein the toothed stop arms are positioned centrally of the support arms to provide stops for small logs or branches.

5. A jig for a chain saw according to claim 1, including a safety mounting bracket to which the support block of the jig is pivotally attached, the safety mounting bracket being fixed to a supporting surface for precluding free movement of the jig and chain saw.

* * * * *